US010214842B2

(12) United States Patent
Kim et al.

(10) Patent No.: US 10,214,842 B2
(45) Date of Patent: Feb. 26, 2019

(54) WASHING MACHINE

(71) Applicant: LG ELECTRONICS INC., Seoul (KR)

(72) Inventors: Woore Kim, Seoul (KR); Sangwoo Lee, Seoul (KR); Jaehyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 54 days.

(21) Appl. No.: 14/813,769

(22) Filed: Jul. 30, 2015

(65) Prior Publication Data

US 2016/0032513 A1 Feb. 4, 2016

(30) Foreign Application Priority Data

Jul. 31, 2014 (KR) ..... 10-2014-0098020
Jul. 31, 2014 (KR) ..... 10-2014-0098021
Jul. 31, 2014 (KR) ..... 10-2014-0098022

(51) Int. Cl.

| | |
|---|---|
| ***D06F 25/00*** | (2006.01) |
| ***D06F 39/08*** | (2006.01) |
| ***D06F 58/22*** | (2006.01) |
| ***D06F 58/20*** | (2006.01) |
| *D06F 58/28* | (2006.01) |
| *D06F 58/26* | (2006.01) |
| *D06F 23/04* | (2006.01) |

(52) U.S. Cl.

CPC ..... *D06F 25/00* (2013.01); *D06F 39/081* (2013.01); *D06F 58/20* (2013.01); *D06F 58/22* (2013.01); *D06F 23/04* (2013.01); *D06F 58/26* (2013.01); *D06F 2058/2864* (2013.01)

(58) Field of Classification Search

CPC .. D06F 39/10; D06F 58/22; D06F 2058/2864; D06F 25/00; D06F 39/081
USPC ..... 68/5 R, 12.14, 12.15
See application file for complete search history.

(56) References Cited

U.S. PATENT DOCUMENTS 5,588,313 A * 12/1996 Hildebrand ..... D06F 25/00 68/17 R
6,832,441 B2 * 12/2004 Jeong ..... D06F 25/00 34/318

(Continued)

FOREIGN PATENT DOCUMENTS

CN 1538000 10/2004
CN 102191649 9/2011

(Continued)

OTHER PUBLICATIONS

Machine translation of JP 2000237497 A, dated Sep. 2000.*

(Continued)

*Primary Examiner* — Joseph L. Perrin
*Assistant Examiner* — Kevin G Lee
(74) *Attorney, Agent, or Firm* — KED & Associates, LLP

(57) ABSTRACT

A washing machine may include a cabinet, a tub, a drum, a driving module for rotating the drum, a water supply module for supplying the wash water to the tub, a drainage module for discharging the wash water from the tub, a drying module at the cabinet for supplying heated air into the tub from an upper side of the tub to dry the laundry, and an exhaust duct coupled to the tub for discharging a fluid in the tub out of the cabinet.

5 Claims, 9 Drawing Sheets

(56) References Cited

U.S. PATENT DOCUMENTS

| | | | | |
|---|---|---|---|---|
| 7,909,939 | B2 * | 3/2011 | Brewer | A47L 15/483 134/56 D |
| 2004/0216326 | A1 * | 11/2004 | Kitamura | D06F 25/00 34/597 |
| 2012/0111066 | A1 * | 5/2012 | Hayashi | D06F 35/003 68/19 |
| 2014/0026433 | A1 * | 1/2014 | Bison | D06F 39/12 34/73 |
| 2016/0376744 | A1 | 12/2016 | Lv | |

FOREIGN PATENT DOCUMENTS

| | | | | |
|---|---|---|---|---|
| CN | 202030951 | | 11/2011 | |
| CN | 10-2482822 | | 5/2012 | |
| CN | 10-3348053 | | 10/2013 | |
| EP | 0335452 | A1 * | 10/1989 | D06F 37/267 |
| JP | H09-774 | | 1/1992 | |
| JP | 2000237497 | A * | 9/2000 | |
| JP | 2003-103087 | | 4/2003 | |
| JP | 2003-326078 | | 11/2003 | |
| JP | 2004-180887 | | 7/2004 | |
| KR | 10-0125274 | | 10/1997 | |

OTHER PUBLICATIONS

Chinese Office Action dated Feb. 4, 2017 issued in Application No. 201510459802.3 (English translation attached).
Chinese Office Action dated Jan. 4, 2017 issued in Application No. 201510459506.3 (English translation attached).
U.S. Office Action issued in U.S. Appl. No. 14/813,757 dated Feb. 15, 2017.
Chinese Office Action dated Oct. 13, 2017 issued in Application No. 201510459802.3.

* cited by examiner

WASHING MACHINE

CROSS-REFERENCE TO RELATED APPLICATIONS

This application claims the priority benefit of Korean Patent Application Nos. 10-2014-0098022, filed Jul. 31, 2014, 10-2014-0098021 filed Jul. 31, 2014, and 10-2014-0098020 filed Jul. 31, 2014, the subject matters of which are incorporated herein by reference.

BACKGROUND

1. Field

Embodiments may relate to a washing machine.

2. Background

A washing machine is an apparatus that washes laundry. The washing machine may remove contaminants from laundry using action of water and detergent. The washing machine removes contaminants from laundry through washing, rinsing, and spin-drying processes.

Based on position of an introduction port, through which the laundry is introduced into the washing machine, the washing machine may be classified as a top loading type washing machine and a front loading type washing machine.

In the top loading type washing machine, the introduction port is vertically provided. In the front loading type washing machine, the introduction port is horizontally provided.

The front loading type washing machine, which may also be referred to as a drum type washing machine, may have a drying module provided therein. A heater may be provided in the drying module for heating air in the washing machine and circulating the heated air to dry the laundry.

However, the top loading type washing machine may be used only to wash, rinse, and spin-dry the laundry. For this reason, a drying module may not be provided in the top loading type washing machine.

One example of the top loading type washing machine is disclosed in Korean Registered Patent No. 10-125274, the subject matter of which is incorporated herein by reference.

BRIEF DESCRIPTION OF THE DRAWINGS

Embodiments may be described in detail with reference to the following drawings in which like reference numerals refer to like elements and wherein;

FIG. 6 is a perspective view of a tub (shown in FIG. 1);

DETAILED DESCRIPTION

Figure 1:
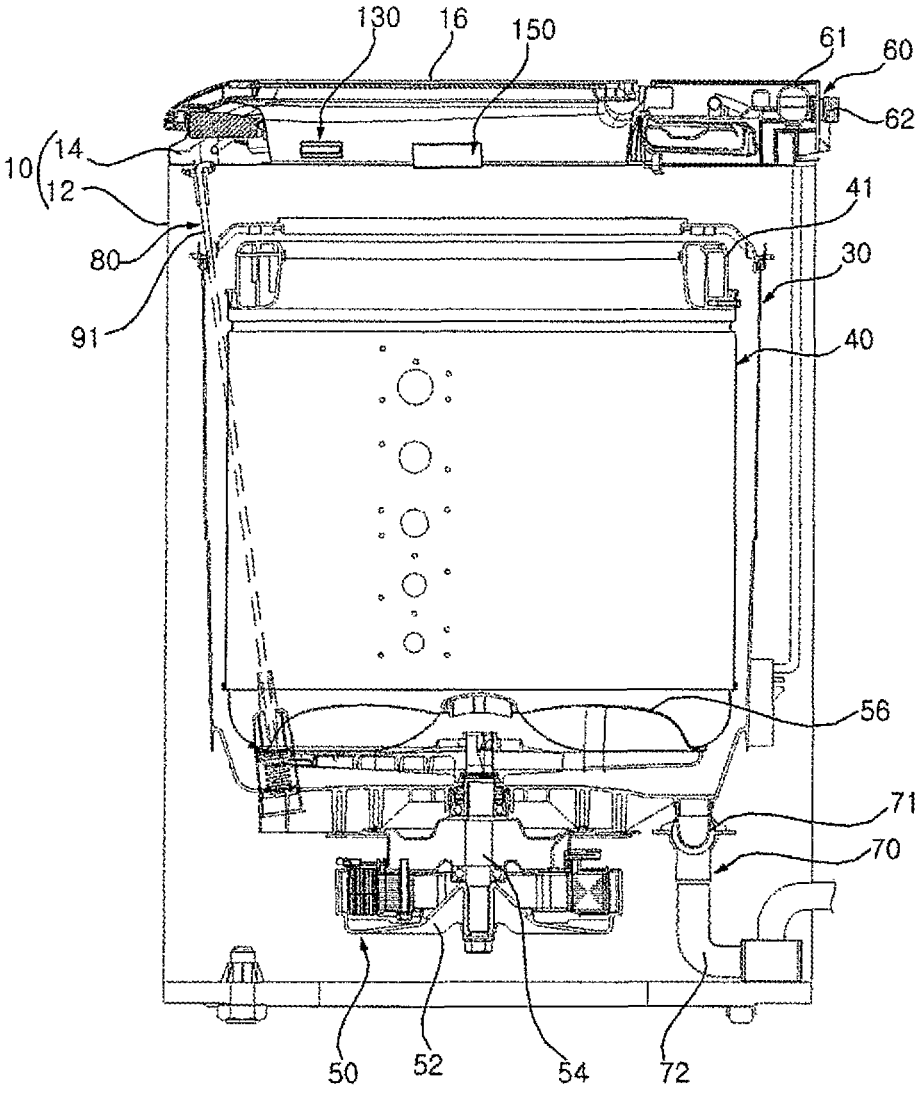
FIG. 1 is a sectional view showing an interior of a washing machine according to a first embodiment.
Figure 2:
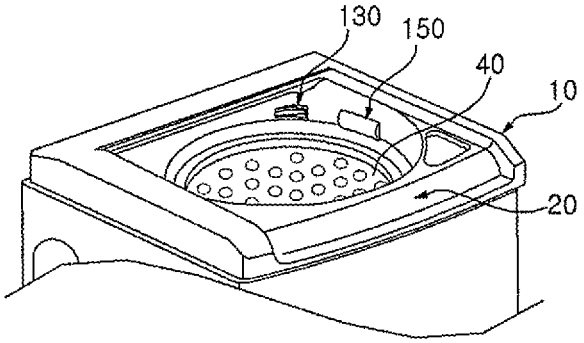
FIG. 2 is a perspective view showing an upper part of the washing machine of FIG. 1.

Advantages, features and methods for achieving those of embodiments may become apparent upon referring to embodiments described in detail together with attached drawings. Embodiments are not limited to the embodiments disclosed hereinafter, but may be embodied in different modes. The embodiments may be provided for perfection of disclosure and informing a scope to persons skilled in this field of art. The same reference numbers may refer to the same elements throughout the specification. Other embodiments and configurations may also be provided.

A washing machine according to a first embodiment may be described with reference to FIGS. 1 to 10.

The washing machine may include a cabinet 10 forming an external appearance of the washing machine, a control module 20 (or control device) mounted at the cabinet 10, a tub 30 disposed in the cabinet 10 for receiving wash water, a drum 40 disposed inside the tub 30 for receiving laundry to be washed, a driving module 50 (or driving device) disposed at the tub 30 for rotating the drum 40 to wash the laundry, a water supply module 60 (or water supply device) for supplying wash water to the tub 30, a drainage module 70 (or drainage device) for discharging the wash water in the tub 30 out of the cabinet 10, a suspension module 80 for reducing or absorbing vibration generated from the tub 30, and a drying module 100 (or drying device) mounted at the cabinet 10 for heating air to dry the laundry.

The cabinet 10 includes a main body 12 opened at a top thereof, a top cover 14 disposed at a top of the main body 12 for covering the top of the main body 12, and a door 16 disposed at the top cover 14 for opening and closing the interior of the cabinet 10.

The tub 30 and the drum 40 are disposed in the main body 12.

A gasket may be disposed at the door 16 for sealing a gap between the door 16 and the top cover 14.

The gasket may seal a circumference of the door 16. Additionally, during operation of the drying module 100, the gasket may prevent the flow of air so as to minimize heat loss.

The control module 20 may include manipulation buttons and dials for allowing a user to input various commands for controlling the washing machine. The control module 20 may further include a display unit (or display) for providing various kinds of information of the washing machine to the user. The display unit may be disposed at the top cover 14.

The tub 30 is connected to the water supply module 60 such that wash water from the water supply module 60 is supplied to the tub 30. The tub 30 is connected to the drainage module 70 such that the wash water in the tub 30 is discharged out of the cabinet 10.

The exhaust duct 160 may be connected to the tub 30. The exhaust duct 160 exhausts heated air in the tub 30 out of the cabinet 10.

The exhaust duct 160 may be connected to the cabinet 10 or the drainage module 70.

An exhaust suction port 162 may be formed at a first end of the exhaust duct 160, and an exhaust discharge port 164 may be formed at a second end of the exhaust duct 160.

The exhaust duct 160 may be vertically provided. The exhaust suction port 162 is connected to a lower part of the tub 30, and the exhaust discharge port 164 is located at an upper side of the tub 30.

The exhaust suction port 162 may be assembled to outside of the tub 30.

The exhaust suction port 162 may be coupled to a lower side of the outside of the tub 30.

A coupling hole 32 may be formed at the lower side of the outside of the tub 30.

The exhaust discharge port 164 may be located higher than a full water level during washing. The exhaust discharge port 164 may be located lower than a balancer 41. The balancer 41 is provided to reduce vibration generated from the drum 40 during rotation of the drum 40. The balancer 41 is located at an upper side of the drum 40.

The balancer 41 is disposed at the upper side of the tub 30 for reducing vibration generated from the tub 30. The balancer 41 is well known to those skilled in the art, and therefore a detailed description thereof may be omitted.

The exhaust discharge port 164 is located to prevent wash water from being discharged out of the tub 30 due to a siphon phenomenon. That is, when the exhaust discharge port 164 is located as described above, wash water may be prevented from being discharged out of the tub 30 due to a siphon phenomenon even when more than a predetermined level of wash water is received in the tub 30.

The exhaust discharge port 164 is connected to the cabinet 10. The exhaust discharge port 164 is connected to a rear of the cabinet 10.

The exhaust duct 160 is manufactured separately from the drainage module 70. Unlike this embodiment, the exhaust discharge port 164 may be connected to the drainage module 70.

During drying of laundry, wet air in the tub 30 may be discharged out of the cabinet 10 via the exhaust duct 160. Alternatively, wet air and condensed water in the tub 30 may be discharged out of the cabinet 10 via the drainage module 70.

The exhaust duct 160 may communicate with outside of the cabinet 10. Unlike this embodiment, a valve may be provided at the exhaust duct 160 for controlling a flow rate of an exhaust fluid.

The drum 40 may be disposed in the tub 30. When a driving force from the driving module 50 is provided to the drum 40, the drum 40 may rotate relative to the tub 30 in a normal direction or in a reverse direction.

The driving module 50 may include a motor 52 at the lower side of the tub 30, a driving shaft 54 connected to the drum 40 through the tub 30, and a pulsator 56 disposed inside the drum 40 such that the pulsator 56 is selectively rotated when a driving force from the motor 52 is provided to the pulsator 56.

The pulsator 56 is disposed inside the drum 40. The pulsator 56 may be rotated in a normal direction or in a reverse direction irrespective of rotation of the drum 40.

The water supply module 60 may include a water supply valve 61 and a water supply channel 62 disposed at the top cover 14.

The drainage module 70 includes a drainage valve 71 connected to the tub 30 and a drainage channel 72 connected to the drainage valve 71.

The suspension module 80 is connected to the tub 30 for reducing vibration generated from the tub 30 using elastic force and/or attenuation.

The drying module 100 is disposed at the top cover 14. More specifically, the drying module 100 is located at the upper side of the tub 30 in a vertical direction of the washing machine. The drying module 100 supplies heated air to the tub 30.

Figure 3:
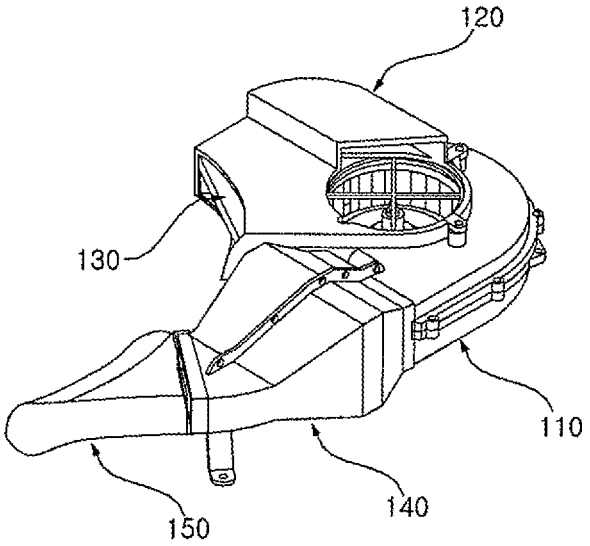
FIG. 3 is a perspective view of a drying module (shown in FIG. 2)
Figure 4:
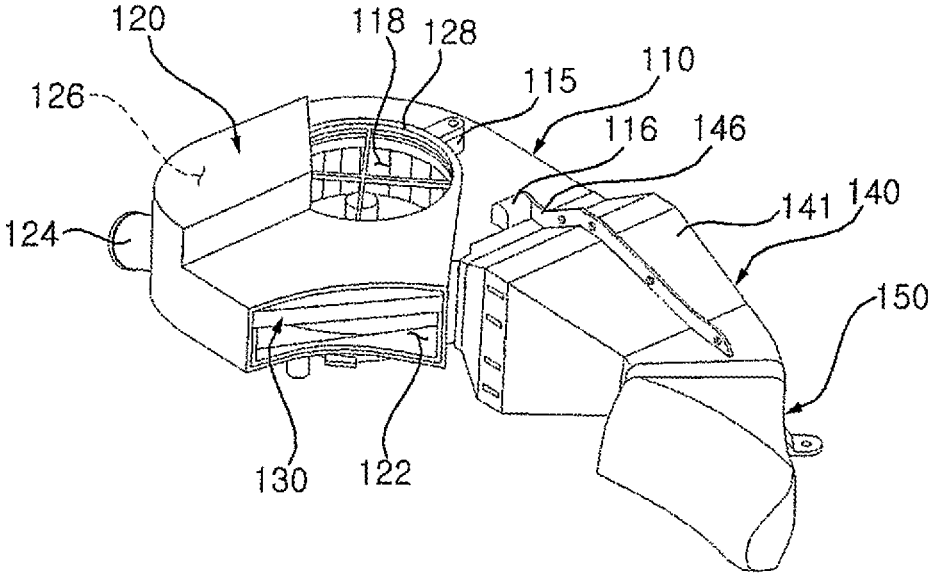
FIG. 4 is a perspective view of the drying module (FIG. 3) when viewed from another side.

As shown in FIG. 3, the drying module 100 includes a blower 110 for blowing air, a suction duct 120 for suctioning air outside the cabinet 10 and air in the cabinet 10 and guiding the suctioned air to the blower 110, a drying filter 130 mounted in the suction duct 120 for filtering foreign matter from air flowing in the suction duct 120, a heater module 140 (or heating device) connected to the blower 110 for heating air blown by the blower 110, and a discharge duct 150 connected to the heater module 140 for guiding air discharged from the heater module 140 into the tub 30.

The blower 110 may be a fan to blow air. Various fans may be used as the blower 110. A turbo fan, which is a type of centrifugal blower, may be used as the blower 110.

The blower 110 may blow the suctioned air to the heater module 140.

Figure 5:
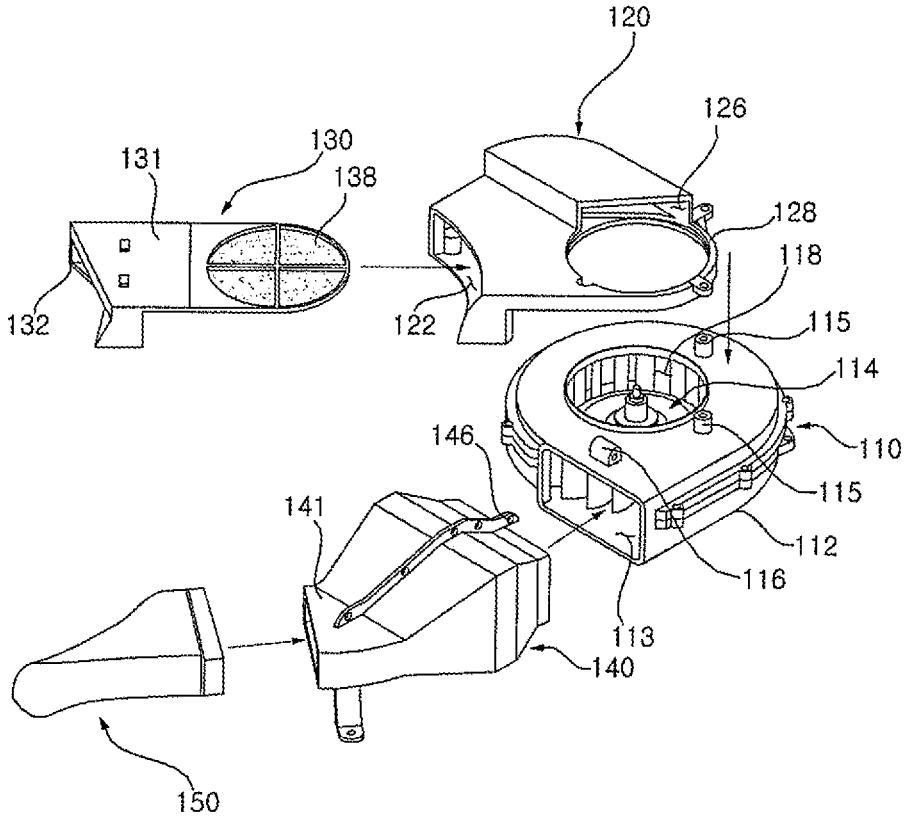
FIG. 5 is an exploded perspective view of the drying module (FIG. 3)
Figure 6:
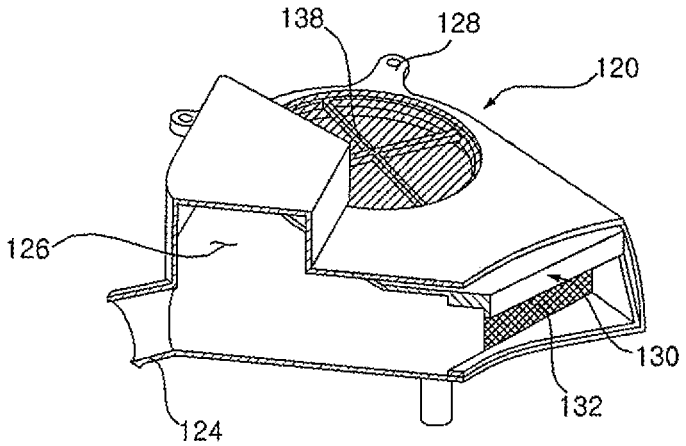
FIG. 6 is a partially cutaway perspective view showing a guide duct of a suction duct shown in FIG. 5.
Figure 7:
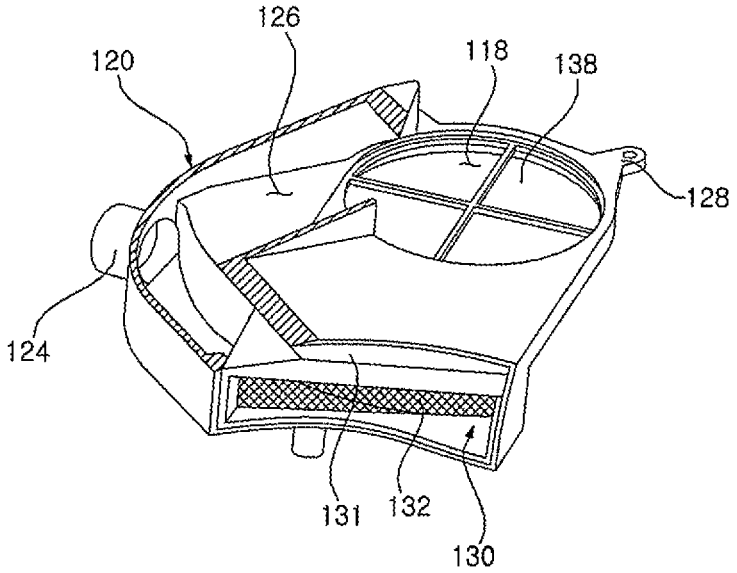
FIG. 7 is a partially cutaway perspective view showing a suction guide of the suction duct shown in FIG. 5.
Figure 8:
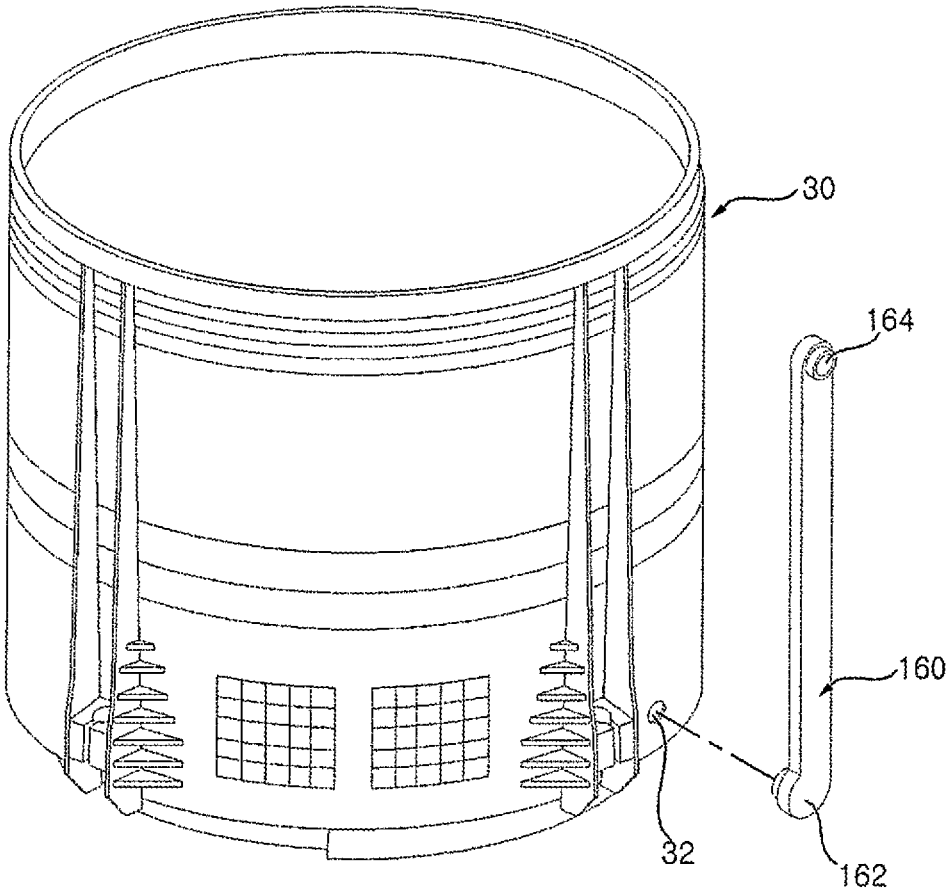
Figure 9:
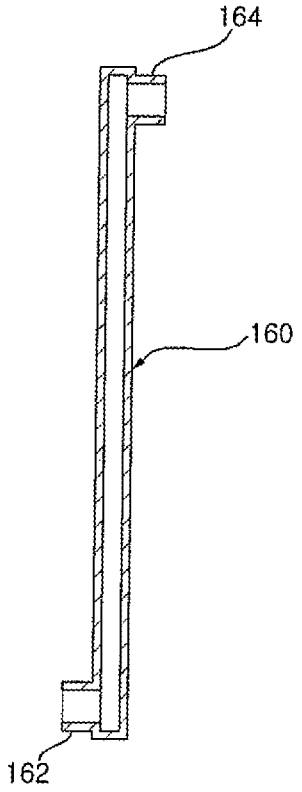
FIG. 9 is a sectional view of an exhaust duct (shown in FIG. 8)

As shown in FIG. 5, the blower 110 includes a fan housing 112 having a fan suction port 118 and a fan discharge port 113, an impeller 114 disposed in the fan housing 112 for suctioning air through the fan suction port 118 and blowing the air to the fan discharge port 113 during rotation of the impeller 114, and a blower motor for driving the impeller 114.

The blower motor is well known to those skilled in the art, and therefore a detailed description may be omitted.

The fan suction port 118 may be formed at the fan housing 112 such that the fan suction port 118 is directed upward from the fan housing 112. The fan suction port 118 may be located at a center of the fan housing 112.

The fan discharge port 113 may be formed at the fan housing 112 such that the fan discharge port 113 is directed outward from the fan housing 112.

The fan housing 112 is connected between the suction duct 120 and the heater module 140. The fan housing 112 includes a suction duct fixing part 115, to which the suction duct 120 is fixed (or attached), and a heater fixing part 116, to which the heater module 140 is fixed (or attached).

The blower 110 may drive the impeller 114. During rotation of the impeller 114, air is suctioned through the fan suction port 118, and air is discharged through the fan discharge port 113. The impeller 114 is configured to have a structure in which air is suctioned in an upward and downward direction, and air is discharged in a circumferential direction. As a result, a height of the fan housing 112 may be minimized.

The suction duct 120 may guide air to the fan suction port 118.

The suction duct 120 may mix air in the cabinet 10 and air outside the cabinet 10. The suction duct 120 is configured to have a structure in which air in the cabinet 10 and air outside the cabinet 10 are mixed, and the mixed air is supplied to the blower 110.

The suction duct 120 may include a circulation suction port 122 communicating with inside of the cabinet 10 for suctioning air in the cabinet 10, a guide duct 124 communicating with outside of the cabinet 10 for suctioning or discharging air outside the cabinet 10, a suction guide 126 for mixing the air suctioned through the circulation suction port 122 and the guide duct 124 and guiding the mixed air to the blower 110, and a suction duct coupling part 128 fixed (or attached) to the fan housing 112.

The circulation suction port 122 is formed so as to be directed to inside of the tub 30. The circulation suction port 122 may mainly suction wet air in the tub 30. The suctioned wet air may flow along the suction guide 126.

The guide duct 124 may communicate with outside of the cabinet 10. The guide duct 124 may extend through the cabinet 10 such that the guide duct 124 is exposed to outside of the cabinet 10. Air outside the cabinet 10 may be suctioned or discharged through the guide duct 124 due to pressure difference formed in the suction guide 126.

When negative pressure is formed in the suction guide 126 (i.e., pressure in the suction guide 126 is lower than pressure outside the cabinet 10), air outside the cabinet 10 may be suctioned into the cabinet 10 through the guide duct 124. On the other hand, when positive pressure is formed in the suction guide 126 (i.e., pressure in the suction guide 126 is higher than pressure outside the cabinet 10), air in the cabinet 10 may be discharged out of the cabinet 10 through the guide duct 124.

Mixing air in the cabinet 10 and air outside the cabinet 10 means that air in the cabinet 10 and air outside the cabinet 10 may be mixed, but does not mean that air in the cabinet 10 and air outside the cabinet 10 are always mixed.

Mixing of air in the cabinet 10 and air outside the cabinet 10 may be performed only when negative pressure is formed in the suction guide 126.

When positive pressure is formed in the suction guide 126, only air in the cabinet 10 circulates without introduction of air outside the cabinet 10, and some of the circulating air in the cabinet 10 is discharged out of the cabinet 10 through the guide duct 124.

Unlike this embodiment, the guide duct 124 may be mounted at the cabinet 10.

The suction guide 126 may be connected to the circulation suction port 122 and the guide duct 124. The suction guide 126 may guide air to the blower 110. When there is no pressure difference or the pressure difference is low, air may not flow along the guide duct 124. As a result, air may not be introduced or discharged through the guide duct 124 although air always flows through the circulation suction port 122. That is, air outside the cabinet 10 may not be suctioned into the cabinet 10 through the guide duct 124, and air in the cabinet 10 may not be discharged out of the cabinet 10 through the guide duct 124.

The suction guide 126 and the fan suction port 118 may be connected to each other in an open state.

Unlike this embodiment, the suction guide 126 and the fan suction port 118 may be connected to each other in a closed state. More specifically, in an example in which the suction guide 126 is directly connected to the fan suction port 118 through a closed duct structure, air is supplied to the blower 110 only through the suction duct 120.

The fan suction port 118 is open into the cabinet 10, and the suction guide 126 is also open into the cabinet 10. The suction guide 126 and the fan suction port 118 are disposed adjacent to each other.

Consequently, mixed air guided through the suction duct 120 is suctioned together with air in the cabinet 10 through the fan suction port 118.

In an example in which the fan suction port 118 is formed to have an open channel structure as described above, not only wet air in the tub 30 is guided to the fan suction port 118 through the suction duct 120, but also heated air between the tub 30 and the cabinet 10 may be suctioned through the fan suction port 118.

In this embodiment, the fan suction port 118, which is open, may circulate air accumulating between the tub 30 and the cabinet 10.

During operation of the drying module 100, air between the tub 30 and the cabinet 10 may be heated to a higher temperature than air outside the cabinet 10. When air between the tub 30 and the cabinet 10 is circulated, power consumption necessary to perform the drying operation may be reduced.

The drying filter 130 may be detachably mounted at the suction duct 120.

The drying filter 130 may be disposed in a flow route of air, along which air flows to the blower 110. The drying filter 130 may prevent foreign matter contained in the air flowing to the blower 110 from being introduced into the blower 110.

As shown in FIG. 5, the drying filter 130 may include a filter body 131, a circulation filter part 132 and a fan filter part 138. The filter body 131 may be coupled to the suction duct 120. The circulation filter part 132, formed at the filter body 131, may be disposed at the circulation suction port 122 for filtering air that is suctioned through the circulation suction port 122. The fan filter part 138, formed at the filter body 131, may be located at the suction duct coupling part 128 for filtering air that is suctioned into the fan housing 112.

The drying filter 130 may be disposed inside the cabinet 10 such that a user can manually separate the drying filter 130 from the cabinet 10. The circulation filter part 132 is exposed to inside of the cabinet 10. The user may check the exposed circulation filter part 132 to intuitively determine whether it is necessary to clean the circulation filter part 132.

The circulation filter part 132 may cover the circulation suction port 122. The circulation filter part 132 is directed to inside of the cabinet 10. The circulation filter part 132 filters air that is suctioned from the tub 30. The circulation filter part 132 mainly collects lint separated from laundry.

The fan filter part 138 covers the fan suction port 118. The fan filter part 138 is located at an upper side of the fan suction port 118. The fan filter part 138 is formed in a circular shape corresponding to that of the fan suction port 118. The fan filter part 138 may have various shapes. The fan filter part 138 filters air that is suctioned through the fan suction port 118.

In the drying module 100, the fan suction port 118 is configured to have an open structure. Even when a large amount of lint is collected by the circulation filter part 132, overall filtering performance may be satisfactorily achieved through the open fan suction port 118.

That is, in a structure in which the suction guide 126 and the fan suction port 118 are connected to each other in a closed state, flow rate of air that is suctioned through the blower 110 may be reduced when a large amount of lint is collected by the circulation filter part 132, and whereby overall drying performance is lowered.

In contrast, in this embodiment, even when a large amount of lint is collected by the circulation filter part with the result that flow rate of air is reduced, air in the cabinet 10 is suctioned through the open fan suction port 118, and whereby a sufficient flow rate of air may be provided.

The drying filter 130 may be inserted through the circulation suction port 122 to simultaneously cover the two suction ports (i.e., the circulation suction port 122 and the fan suction port 118).

The heater module 140 may heat air blown by the blower 110. The heater module 140 may be configured as a separate component. Unlike this embodiment, the heater module 140 may be mounted at the suction duct 110, the discharge duct 150, or the blower 110.

In this embodiment, the heater module 140 may include a heater body 141 disposed between the blower 110 and the discharge duct 150 for interconnecting the blower 110 and the discharge duct 150, a heater disposed in the heater body 141, and a heater coupling part 146, formed at the heater body 141, to couple to the blower 110.

The heater coupling part 146 may be assembled to the heater fixing part 116 of the blower 110.

A positive temperature coefficient (PTC) heater may be used as the heater. Operating principles and structures of the PTC heater are well known to those skilled in the art, and therefore a detailed description thereof may be omitted.

The heater body 141 may be formed such that the air discharge area of the heater body 141 gradually decreases toward the discharge duct 150. As the air discharge area of the heater body 141 decreases, heated air may be discharged at a high speed.

The heater is disposed in the heater body 141. The heater exchanges heat with the air blown by the blower 110.

The suction side of the heater body 141 has a same area as the discharge side of the blower 110, and the discharge side of the heater body 141 has a same area as the discharge duct 150. A middle part of the heater body 141, between the suction side and the discharge side of the heater body 141, has a larger area than the suction side and the discharge side of the heater body 141. An interior of the heater body 141 receives a large amount of air. As a result, heat exchange between the heater and the air may be effectively achieved. The middle part of the heater body 141 may have a larger heat exchange space than the suction side and the discharge side of the heater body 141.

Air blown by the blower 110 flows to the heater body 141, and speed and pressure of the air decrease in the heat exchange space of the heater body 141. Consequently, heat exchange between the heater and the air is effectively achieved. The air heat-exchanged in the heat exchange space of the heater body 141 moves to the discharge side of the heater body 141 having a smaller area than the heat exchange space of the heater body 141. The speed and pressure of the air may increase.

The discharge duct 150 may be integrally formed with the heater body 141.

The discharge duct 150 may guide air heated by the heater module 140 into the tub 30. The discharge duct 150 discharges the heated air into the tub 30. The discharge duct 150 may adjust a discharge direction and angle of the heated air to improve circulation of air in the cabinet 10.

The discharge duct 150 may discharge the heated air downward from the upper side of the tub 30. As the heated air is discharged downward, the heated air may move downward in the tub 30.

The discharge duct 150 may discharge the heated air toward the inside of the tub 30 or the drum 40. More specifically, the discharge duct 150 may be disposed such that the heated air is discharged toward the inside of the tub 30 or the drum 40. The discharge duct 150 may discharge the heated air in a direction tangent to the inside of the tub 30 or the drum 40, when viewed from a top view.

The air discharged through the discharge duct 150 may move downward in the tub 30 or the drum 40 while flowing in a spiral manner (or spiral shape).

In an example in which the air flows in a spiral shape (or manner) as described above, time during which the air stays in the drum 40 may increase. In an example in which time during which the heated air stays in the drum 40 increases, time during which the air exchanges heat with laundry increases, thereby improving drying efficiency.

The suction duct 120 and the discharge duct 150 are located at different heights. The discharge duct 150 may be located lower than the suction duct 120 so as to reduce resistance to the flow of air.

More particularly, in an example in which the suction duct 120 is located higher than the discharge duct 150 (as in this embodiment), high-temperature air collected at the upper side of the tub 30 may be suctioned into the suction duct 120. In this embodiment, the suction duct 120 mounted at the top cover 14 may suction and discharge the high-temperature air collected in the cabinet 10 at the upper side of the cabinet 10, thereby preventing stay of the high-temperature.

Operation of the drying module according to the first embodiment may be described in detail with reference to the drawings.

When the blower 100 is powered on, the impeller 114 is driven. As a result, air is suctioned through the fan suction port 118, and is then discharged to the heater module 140.

The air suctioned through the fan suction port 118 includes air guided through the suction duct 120 and air around the blower 110. The air around the blower 110 may be air between the tub 30 and the cabinet 10.

The suction duct 120 guides air in the tub 30 to the blower 110 through the circulation suction port 122.

Air outside the cabinet 10 may be suctioned into the suction duct 120 depending upon pressure in the suction duct 120. That is, when negative pressure is formed in the suction duct 120, air outside the cabinet 10 may be suctioned into the suction duct 120 through the guide duct 124.

On the other hand, air in the suction duct 120 may be exhausted out of the cabinet 10 depending upon pressure in the suction duct 120. That is, when positive pressure is formed in the suction duct 120, air in the suction duct 120 may be exhausted out of the cabinet 10 through the guide duct 124.

The inside and the outside of the cabinet 10 communicate with each other through the guide duct 124. As a result, pressure equilibrium is maintained, and a siphon phenomenon may be prevented during the supply of water.

When the water level of the tub 30 increases in a state in which the cabinet 10 is closed, a siphon phenomenon occurs with a result that water in the tub 30 may be discharged out of the cabinet 10. The inside and the outside of the cabinet 10 communicate with each other through the guide duct 124, thereby preventing the occurrence of the siphon phenomenon.

During operation of the blower 110, air is introduced or discharged through the guide duct 124 due to pressure difference. During operation of the blower 110, only air in the cabinet 10 may flow in the suction guide 126, or mixed air including air outside the cabinet 10 and air in the cabinet 10 may flow in the suction guide 126.

The pressure in the cabinet 10 may change according to operation of the heater module 140.

For example, since temperature in the cabinet 10 increases from the initial stage to the middle stage of operation of the drying module 100, wet air in the cabinet 10 is discharged out of the cabinet 10 through the guide duct 124. As the wet air is discharged out of the cabinet 10, load is reduced, thereby increasing drying efficiency.

Since temperature in the cabinet 10 is maintained at a fixed level from the middle stage to the last stage of the operation of the drying module 100, air outside the cabinet 10 may be suctioned into the cabinet 10. When the air outside the cabinet 10 is suctioned into the cabinet 10, an increase of temperature in the cabinet 10 is restrained.

The air blown by the blower 110 may be heated by the heater module 140 while passing through the heater module 140. The air heated by the heater module 140 is discharged into the tub 30 through the discharge duct 150.

The air discharged into the tub heats the laundry, and moisture is evaporated from the heated laundry. After heating the laundry, the air is suctioned through the suction duct 120, and is then circulated as described above.

The moisture evaporated from the laundry may contact the inside of the tub 30 into condensed water, and the condensed water may move to the lower side of the tub 30, at which the condensed water may be collected.

During operation of the drying module 100, the drainage module 70 may be intermittently operated to discharge the wet air and the condensed water out of the cabinet 10. The drainage module 70 may be continuously operated according to temperature in the cabinet 10 and the drying process.

During operation of the drying module 100, air in the tub 30 may be discharged out of the cabinet 10 through the exhaust duct 160.

In an example in which a larger amount of wash water than the full water level is supplied during a washing cycle, an excess of the wash water may be discharged through the exhaust duct 160 irrespective of operation of the drainage module 70. Since the exhaust discharge port 164 (of the exhaust duct 160) is located higher than the full water level, it is possible to prevent all of the supplied wash water from being discharged due to a siphon phenomenon.

Figure 10:
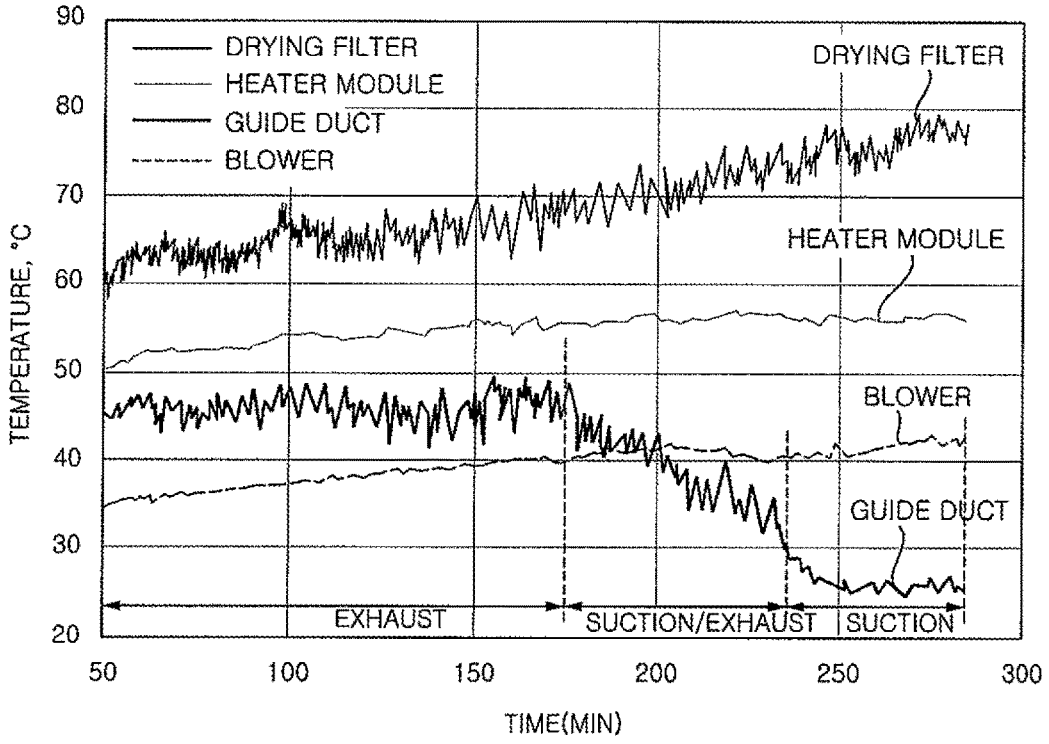
FIG. 10 is a graph showing a change in temperature of respective components of a washing machine during operation of a drying module according to an embodiment.

FIG. 10 is a graph showing a change in temperature of respective components of a washing machine during operation of a drying module according to this embodiment.

The graph shows temperatures of the drying filter 130, the heater module 140, the blower 110, and the guide duct 124 over time.

The temperatures of the drying filter 130, the heater module 140, and the blower 110 may uniformly increase over time.

The temperature of the guide duct 124 is changed according to exhaust, suction/exhaust, and suction.

During the exhaust period, air in the cabinet 10 is exhausted out of the cabinet 10. The temperature of the guide duct 124 may be almost uniform over time.

During the suction/exhaust period, air outside the cabinet 10 is suctioned into the suction duct 120 through the guide duct 124, or air in the cabinet 10 is exhausted out of the cabinet 10. The suction of the air outside the cabinet 10 and the exhaust of the air in the cabinet 10 may be alternatively or intermittently performed based on pressure in the suction duct 120.

The temperature of the guide duct 124 may gradually decrease during the suction/exhaust period since air outside the cabinet 10 is suctioned into the suction duct 120.

During the suction period, air outside the cabinet 10 may be suctioned into the suction duct 120 due to the pressure difference, and air outside the cabinet 10 is mixed with air in the suction duct 120. The temperature of the guide duct 124 may be maintained at a low temperature.

Figure 11:
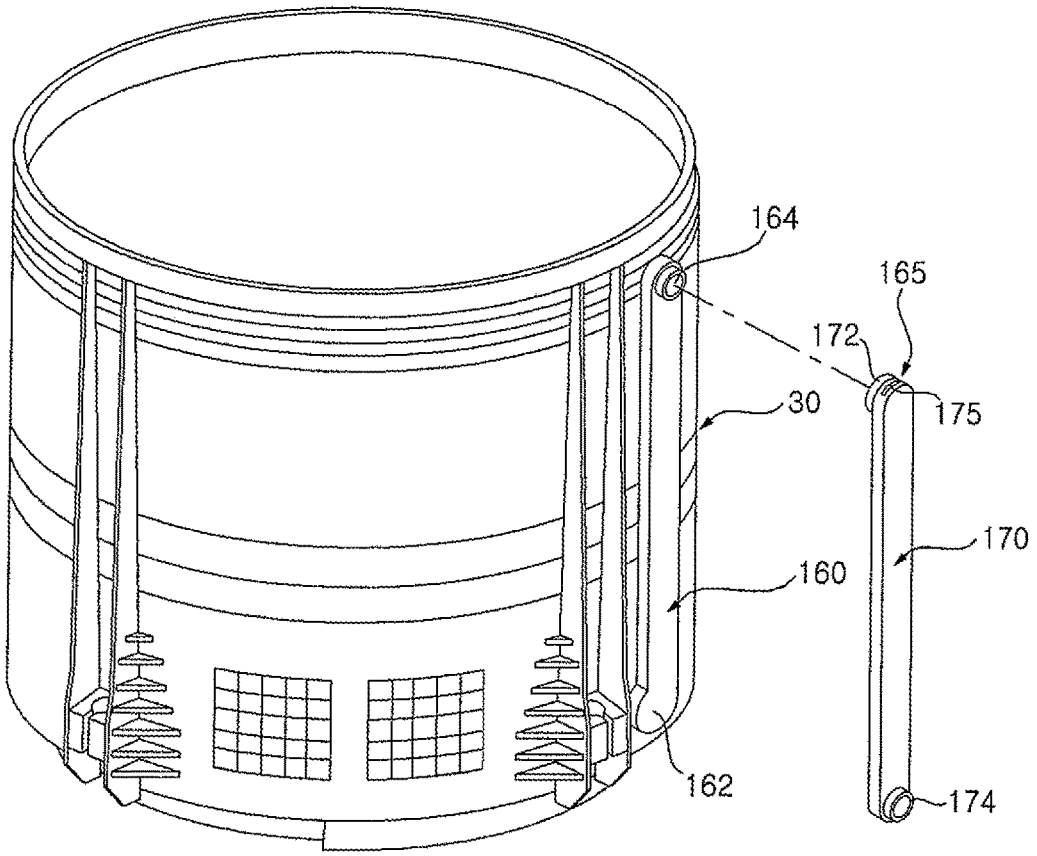
FIG. 11 is a partially exploded perspective showing a tub and an exhaust duct according to a second embodiment.

FIG. 11 is a partially exploded perspective showing a tub and an exhaust duct according to a second embodiment. Other embodiments and configurations may also be provided.

In this embodiment, an extension duct 170 is provided at the exhaust duct 160.

A first end 172 of the extension duct 170 may be connected to the exhaust discharge port 164, and a second end 174 of the extension duct 170 may be connected to the cabinet 10 or the drainage channel 72.

The second end 174 of the extension duct 170 may be located at the same height as the exhaust suction port 162.

The extension duct 170 and the exhaust duct 160 form a turning part 165 for turning the flow of a fluid by 180 degrees in a vertical direction. A slit 175 communicating with an interior of the cabinet 10 may be formed at the turning part 165.

The slit 175 may be formed at the first end 172 of the extension duct 170. Unlike this embodiment, the slit 175 may be formed at the exhaust discharge port 164 of the exhaust duct 160.

The slit 175 communicates with the interior of the turning part 165. The slit 175 restrains occurrence of a siphon phenomenon. When a predetermined air layer is formed in the turning part 165 through the slit 175, the occurrence of the siphon phenomenon may be prevented even when wash water is excessively supplied.

The extension duct 170 may be connected to the cabinet 10 or the drainage module 70. The extension duct 170 may be connected to the drainage channel 72.

Other components of this embodiment are identical in construction to those of previous embodiments, and therefore a detailed description may be omitted.

As is apparent from the above description, the washing machine may have one or more of the following effects.

1) The drying module may be mounted at the top cover, thereby easily supplying heated air into the tub.

2) Wet air generated during drying is exhausted out of the cabinet through the exhaust duct, thereby improving drying efficiency.

3) Air outside the cabinet and air in the cabinet is mixed in the suction duct, and the mixed air is supplied to the blower.

4) The drying filter is mounted through the suction duct exposed in the cabinet.

5) Air suctioned from the tub is filtered through the circulation filter part of the drying filter, and air suctioned from the cabinet is filtered through the fan filter part of the drying filter.

6) The fan suction port of the blower is open. Even when the circulation filter part disposed in the suction duct is clogged by lint, air in the cabinet is suctioned through the fan suction port, thereby maintaining the drying performance.

7) During drying of laundry, air in the cabinet is exhausted out of the cabinet according to pressure difference between the inside and the outside of the cabinet, thereby improving drying efficiency. Additionally, air outside the cabinet is suctioned into the cabinet according to the pressure difference between the inside and the outside of the cabinet, thereby restraining the increase in temperature of the drying module.

8) The exhaust discharge port of the exhaust duct is disposed lower than a balancer, and is disposed higher than a full water level of wash water supplied during washing, thereby preventing the occurrence of a siphon phenomenon.

9) Wet air within the tub may be discharged out of the cabinet through the exhaust duct during drying.

It is an object to provide a washing machine having a drying module mounted therein.

It is another object to provide a washing machine that is capable of exhausting wet air (in a cabinet) out of the cabinet during drying of laundry, and thereby improving drying efficiency.

It is another object to provide a washing machine that is capable of mixing air in a cabinet and air outside the cabinet and providing the mixed air to a blower.

It is another object to provide a washing machine having a drying filter mounted through a suction duct.

It is another object to provide a washing machine that is capable of filtering air suctioned from a tub through a drying filter mounted through a suction duct and air suctioned from a cabinet.

It is another object to provide a washing machine that discharges heated air into a tub from an upper part of the tub.

It is a further object to provide a washing machine that is capable of suctioning air (outside a cabinet) into the cabinet or exhausting air (in the cabinet) out of the cabinet based on pressure difference between the inside and the outside of the cabinet during drying of laundry.

It is another object to provide a washing machine that is capable of discharging air in a tub out of a cabinet during drying.

It is a further object to provide a washing machine that is capable of preventing wash water from being discharged due to a siphon phenomenon.

The above and other objects can be accomplished by the provision of a washing machine including a cabinet having a door, through which laundry is introduced from above, a tub disposed in the cabinet for receiving wash water, a drum disposed inside the tub for receiving the laundry, a driving module disposed at the tub for rotating the drum, a water supply module for supplying the wash water to the tub, a drainage module for discharging the wash water from the tub, a drying module mounted at the cabinet for supplying heated air into the tub from an upper side of the tub to dry the laundry, and an exhaust duct coupled to the tub for discharging a fluid in the tub out of the cabinet.

A washing machine may include a cabinet having a door, through which laundry is introduced from above, and a tub disposed in the cabinet for receiving wash water. The washing machine may further include a top cover at which the door is disposed, a drying module mounted at the top cover for supplying heated air into the tub from an upper side of the tub to dry the laundry, and an exhaust duct coupled to the tub for discharging a fluid in the tub out of the cabinet.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a cabinet having a door at a top area of the cabinet;

a tub in the cabinet to receive wash water;

a drum inside the tub to receive laundry;

a driving device at the tub to rotate the drum;

a water supply device to supply the wash water to the tub;

a balancer to reduce vibration from the tub, the balancer disposed at an upper side of the tub;

a drainage device includes a drainage valve connected to the tub and a drainage channel coupled to the drainage valve to discharge the wash water from the tub;

a drying device at the cabinet to supply heated air to the tub, the heated air to dry the laundry;

an exhaust duct coupled to the tub to discharge air within the tub to outside of the cabinet, the exhaust duct disposed in a vertical direction, and the exhaust duct disposed between the tub and the cabinet; and an extension duct, disposed in the vertical direction, and disposed between the tub and the cabinet, the extension duct having a first end coupled to the exhaust duct and a second end coupled to the cabinet;

wherein the exhaust duct includes:

an exhaust suction port to couple to a lower side of the tub, the exhaust suction port provided at the first end of the exhaust duct, and the exhaust suction port always communicating with inside of the tub, and an exhaust discharge port provided higher than the exhaust suction port, the exhaust discharge port provided at the second end of the exhaust duct;

wherein the first end of the extension duct coupled to the exhaust discharge port forms a turning part for turning the air by 180 degrees in the vertical direction, the first end of the extension duct is disposed to be higher than a full water level of wash water supplied in the tub during washing, and the first end of the extension duct always communicating with the exhaust discharge port, wherein the second end of the extension duct is disposed lower than the full water level of wash water supplied in the tub during washing, and the second end of the extension duct is coupled to discharge the air from within the tub to outside of the cabinet, and the second end of the extension duct always communicating with outside of the cabinet, wherein the turning part includes a slit disposed at a top end of the extension duct and facing a hollow interior of the cabinet, and wherein the slit always communicating with the hollow interior of the cabinet, formed in the vertical direction, the slit opening toward an upper side of the hollow interior of the cabinet for restraining occurrence of a siphon phenomenon, the slit being opened at an upper side of the turning point, wherein the exhaust discharge port is provided lower than the balancer, and the exhaust discharge port is provided higher than the full water level of wash water supplied during washing, wherein the turning part is lower than the balancer, and the turning part is higher than the full water level of wash water supplied during washing.

2. The washing machine according to claim 1, wherein the cabinet includes a top cover at the top area, wherein the door is at the top cover, and the drying device is disposed at the top cover of the cabinet.

3. The washing machine according to claim 2, wherein the drying device includes:

a blower to blow air;

a suction duct to guide air in the cabinet to the blower;

a drying filter at the suction duct to filter foreign matter;

a discharge duct to guide the air from the blower to the tub; and a heater device disposed in a flow path of air via the suction duct, the blower, and the discharge duct, wherein the heater device to heat the air.

4. The washing machine according to claim 3, wherein the suction duct includes:

a circulation suction port communicating with inside of the cabinet;

a guide duct communicating with outside of the cabinet; and a suction guide coupled to the circulation suction port and the guide duct, the suction guide to guide air to the blower.

5. The washing machine according to claim 4, wherein the blower includes a fan housing having a fan suction port and a fan discharge port, the fan suction port being open to the cabinet, and the fan discharge port to discharge air to the heater device or the discharge duct, and the drying filter includes:

a fan filter part at the suction duct, the fan filter part to cover the fan suction port and to filter foreign matter from air flowing to the fan suction port; and a circulation filter part at the suction duct, the circulation filter part to cover the circulation suction port and to filter foreign matter from air flowing to the circulation suction port.

* * * * *